US007047790B2

(12) United States Patent
Suzuki et al.

(10) Patent No.: US 7,047,790 B2
(45) Date of Patent: May 23, 2006

(54) WORKPIECE CARRIER APPARATUS FOR TRANSFER PRESS MACHINE

(75) Inventors: Masaru Suzuki, Yokosuka (JP); Shigeki Narishima, Yokosuka (JP); Kohji Osada, Yokohama (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 0 days.

(21) Appl. No.: 10/663,224

(22) Filed: Sep. 16, 2003

(65) Prior Publication Data

US 2004/0177669 A1 Sep. 16, 2004

(51) Int. Cl.
*B21D 43/05* (2006.01)

(52) U.S. Cl. ..... 72/405.11; 72/405.1; 72/405.01; 198/621.1

(58) Field of Classification Search ..... 72/405.16, 72/405.1, 405.01, 405.11; 414/752.1; 198/621.1
See application file for complete search history.

(56) References Cited

U.S. PATENT DOCUMENTS 4,981,031 A * 1/1991 Schneider et al. ..... 72/405.05
5,727,416 A * 3/1998 Allgoewer ..... 72/405.11
5,737,960 A * 4/1998 Brandstetter et al. .... 72/405.16
5,979,212 A * 11/1999 VanderZee et al. ..... 72/405.09

FOREIGN PATENT DOCUMENTS

JP 10-328766 12/1998

OTHER PUBLICATIONS

English translation of Abstract for Japanese Unexamined Patent Application, First Publication No. Hei 10-328766 dated Dec. 15, 1998.

* cited by examiner

*Primary Examiner*—Daniel C. Crane
(74) *Attorney, Agent, or Firm*—Ostrolenk, Faber, Gerb & Soffen, LLP

(57) ABSTRACT

There is provided a workpiece carrier apparatus for transfer press machine in which carrier motion for each press station can be individually set. A guide beam can be raised and lowered by a lifting device so that all levels can be adjusted to match the dies. A guide rail is attached to the guide beam, and carriers are fitted so as to be movable in the feed direction of a press line along the guide rail. A most upstream side carrier on the press line is moved in the feed direction by a first carrier mechanism, and the remaining carriers are connected together by connecting rods so as to be movable in the feed direction as one unit by a second carrier mechanism. Each of the carriers have a servo motor and the amount of raising and lowering of the cross bars can be individually set.

7 Claims, 5 Drawing Sheets

WORKPIECE CARRIER APPARATUS FOR TRANSFER PRESS MACHINE

BACKGROUND OF THE INVENTION

1. Field of the Invention

The present invention relates to a workpiece carrier apparatus for transfer press machine to carry workpiece to a press station, and to hold workpiece pressed and processed at one press station, and carry it to the next press station for sequential press forming.

2. Description of the Related Art

A transfer press machine conducts press operations while carrying workpiece press formed at various press stations to the next press station in sequence, and synchronized with the raising and lowering operation of an upper die. The transfer press machine incorporates a workpiece carrier apparatus. The workpiece carrier apparatus incorporates a cross bar fitted with a workpiece holder which operates between adjacent press stations in an approximately rectangular movement to constitute a carrier motion. Workpiece press formed at an upstream press station is gripped in the workpiece holder and lifted, carried to the next downstream press station, and then lowered and moved onto the lower die of the press station.

A variety of mechanisms are used for the workpiece carrier apparatus for transfer press machine. In the majority, carriers incorporating a cross bar and are installed at each press station perform feed operation and raising and lowering operation.

FIG. 9 shows one example in outline. Press stations 6 for forming the workpiece with a press die comprising a lower die 3 installed via a bolster 2, and an upper die 5 placed such as to be capable of being raised and lowered by a slide 4 above the lower die 3, are arranged apart at required spacing at multiple locations along a press line L on a bed 1 installed along the press line L. Furthermore, on both sides of the press line L is arranged a pair of left and right lifting beams 7, parallel with the direction of the press line L, and symmetrical with the press line L therebetween, each of the left and right lifting beams 7 being capable of movement in the vertical direction (raised and lowered) via a rack and pinion mechanism 9 driven by an AC servo motor 8 mounted above. Moreover, multiple carriers 10 arranged to match the spacing of the press stations 6 are installed on each of the left and right lifting beams 7 such as to be able to run along the press line L, and cross bars 11 extending at right angles to the direction of the press line L and fitted with workpiece holders 12 are arranged between the carriers 10 opposed in the left-right direction, and both ends of the cross bars 11 are supported by the left and right carriers 10. On the other hand, adjacent carriers 10 in the direction of the press line L are connected via connecting rods 13, and a rack and pinion mechanism 15 fitted with an AC servo motor 14 is connected to the carrier 10 on one end in the direction of the press line L via a connecting rod 16. As described above, the carriers 10 and cross bars 11 fitted with the workpiece holders 12 are capable of being moved vertically by the raising and lowering of the lifting beam 7 driven by the AC servo motor 8. Moreover, movement of all carriers 10 in synchronization in the direction of the press line L via the rack and pinion mechanism 15 driven by the AC servo motor 14 and the connecting rods 16 and 13, allows movement of the cross bars 11 fitted with the workpiece holders 12, in the direction of the press line L (see for example, Japanese Unexamined Patent Application, First Publication No. Hei 10-328766).

In practice, with the conventional workpiece carrier apparatus for transfer press machine described above, the cross bars 11 are supported on each carrier 10 fitted to the lifting beam 7, and movement of each cross bar 11 vertically and in the direction of the press line L is all simultaneous and uniform. Therefore, the workpiece cannot be carried with a different motion at each press station 6. Hence, only the same operation is possible for the workpiece carrying motion (interference curve) at each press station, thus restricting die shape in order to avoid interference, and resulting in problems in forming of a diverse range of workpiece.

SUMMARY OF THE INVENTION

The present invention is a further advance on the aforementioned conventional apparatus, and provides a workpiece carrier apparatus for transfer press machine in which a different workpiece carrying motion may be set individually for each press station to carry workpiece, as well as allowing the same operation of cross bars fitted with workpiece holders attached to any carrier.

In order to resolve the aforementioned problems, the workpiece carrier apparatus for transfer press machine according to the present invention comprises: guide beams which are arranged on a left and right side of a press line; a plurality of carriers which are supported by the guide beams such as to allow movement in a direction of the press line; cross bars which are provided with workpiece holders and are attached to the carriers such as to be capable of being raised and lowered; a first carrier mechanism which feeds a carrier located on a most upstream side in the direction of the press line, in the press line direction; and a second carrier mechanism which feeds a plurality of carriers located downstream in the press line direction, in the press line direction. Moreover, each of the carriers in this configuration may comprise a vertically moving bodies capable of being raised and lowered independently, and a drive device which drives the vertically moving body, and the cross bars may be fitted between vertically moving bodies of mutually opposed carriers on the left and right guide beams.

Of the plurality of carriers arranged along the press line, the carrier at the most upstream position in the direction of the press line and the other downstream side carries are able to move and carry workpiece independently. Sheet material supplied to the press line as workpiece is therefore able to be carried to the first press station by independent movement of the most upstream side carrier. Moreover, by ensuring that independent shift operation is possible with the drive devices provided in each carrier, it is possible to establish individual carrying motions, and to design and manufacture dies in accordance only with essential die functions, and without restrictions on the amount of carrying or raising and lowering. Furthermore, the ability to establish optimum individual motions without restriction on the dies of each press station allows a reduction in carrying time, and increases the number of press cycles per unit time, thus raising productivity.

Moreover, each of the carriers may comprise a vertically moving body capable of being raised and lowered, and the workpiece carrier apparatus may further comprise drive devices to raise and lower vertically moving bodies of a plurality of groups of adjacent carriers, and a power transmission mechanism connecting the drive devices, and the vertically moving bodies may be raised or lowered simultaneously by any of the drive devices corresponding to the respective groups, and the cross bars may be fitted between the vertically moving bodies of mutually opposed carriers on the left and right guide beams. As a result, the adjacent multiple carriers are able to carry, and raise and lower, simultaneously irrespective of a fault in any drive device.

Moreover, the workpiece carrier apparatus for transfer press machine according to the present invention comprises: feed beams which are arranged on a left and right side of a press line such as to allow movement in a direction of the press line: vertically moving bodies which are fitted at required locations for the feed beams so as to be capable of being raised and lowered; lifting devices which are installed corresponding to each vertically moving body for raising and lowering the vertically moving bodies; and cross bars which are provided with workpiece holders, and are fitted between mutually opposed vertically moving bodies provided on the feed beams.

In this configuration, each of the lifting devices may be installed above each of the feed beams and corresponding to the vertically moving body. Moreover, the lifting devices may be installed at positions above the feed beams, and the workpiece carrier apparatus may be further provided with a connecting rod which connects the lifting devices and the vertically moving bodies in a freely swinging manner. By means of these configurations, even with an arrangement where feed is provided with the feed beam, the amount of raising and lowering may be set individually for each press station, and the dies may thus be designed and manufactured without restrictions imposed by the amount of carrying or raising and lowering.

DETAILED DESCRIPTION OF THE PREFERRED EMBODIMENTS

Figure 1:
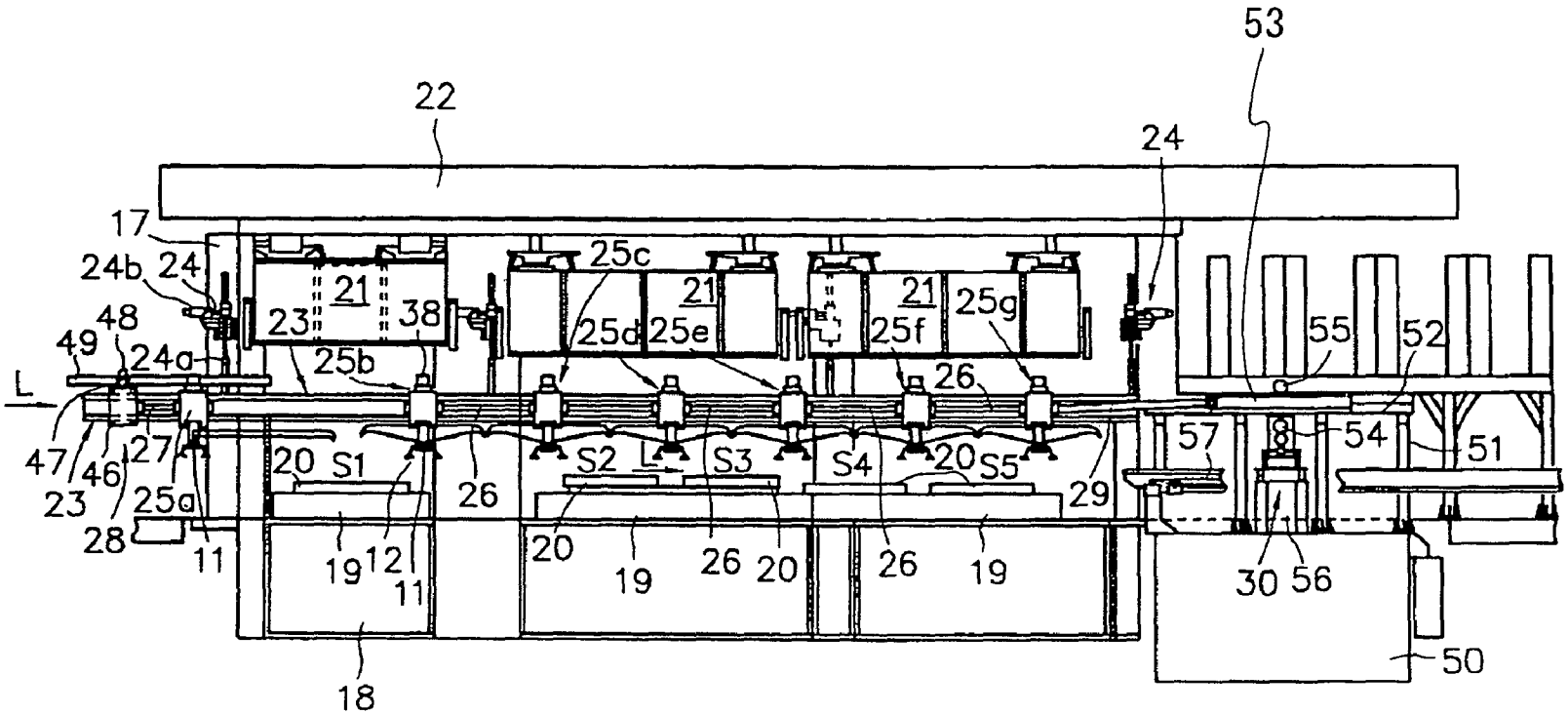
FIG. 1 is a schematic diagram showing an embodiment of a workpiece carrier apparatus for transfer press machine according to the present invention.

The following describes embodiments of the present invention with reference to the drawings.

FIG. 1 through FIG. 4 show the outline of an embodiment of a workpiece carrier apparatus for transfer press machine according to the present invention. In the press machine shown in the figures, a first press station S1, a second press station S2, a third press station S3, a fourth press station S4, and a fifth press station S5 are established in sequence at required spacing between the upstream side and the downstream side of a press line L at a lower portion of a press frame 17. Furthermore, lower dies 20 are respectively installed on bolsters 19 on bases 18 at the press stations S1, S2, S3, S4, and S5, and slides 21 are installed on the press frame 17 such as to be capable of being moved vertically by a slide drive device 22. The upper dies (not shown in drawings) corresponding to the lower dies 20 of each of the press station S1, S2, S3, S4, and S5 are fitted to the bottom faces of the slides 21, and workpiece is press formed and processed at each press station S1, S2, S3, S4, and S5 by the press dies comprised of the upper die and lower die 20. This press machine incorporates the following configuration.

Guide beams 23 on the left and right sides of the press line L are located parallel to the direction of the press line L, and the left and right guide beams 23 are capable of being raised and lowered by a lifting device 24 along the press frame 17. Moreover, a plurality of (seven in the direction of the press line L in the figure) carriers 25*a*, 25*b*, 25*c*, 25*d*, 25*e*, 25*f*, and 25*g* are each arranged symmetrically left and right, and supported on the left and right guide beams 23 to permit movement in the direction of the press line L. Except for carrier 25*a* at the most upstream position oil the press line L, all adjacent carriers 25*b*, 25*c*, 25*d*, 25*e*, 25*f*, and 25*g* are connected by a connecting rod 26 so that the carriers 25*b*, 25*c*, 25*d*, 25*e*, 25*f*, and 25*g* are able to move together in the direction of the press line L. A first carrier mechanism 28 is provided at the upstream side of the press line L, and it is connected to the aforementioned carrier 25*a* via a connecting rod 27 so as to move the carrier 25*a* in the direction of the press line L. Furthermore, A second carrier mechanism 30 is provided at the downstream side of the press line L, and it is connected via a connecting rod 29 to the carrier 25*g* at the last downstream position so as to impart a feed operation to the connecting rod 29 in the direction of the press line L. Moreover, a cross bar head 31 supporting both ends of the cross bar 11 extending in a direction at right angles to the press line L, is supported on each of the left and right mutually opposed carriers 25*a*, 25*b*, 25*c*, 25*d*, 25*e*, 25*f*, and 25*g* supported on the aforementioned left and right guide beams 23 to allow raising and lowering, and a workpiece holder 12 is fitted to each cross bar 11.

Figure 3:
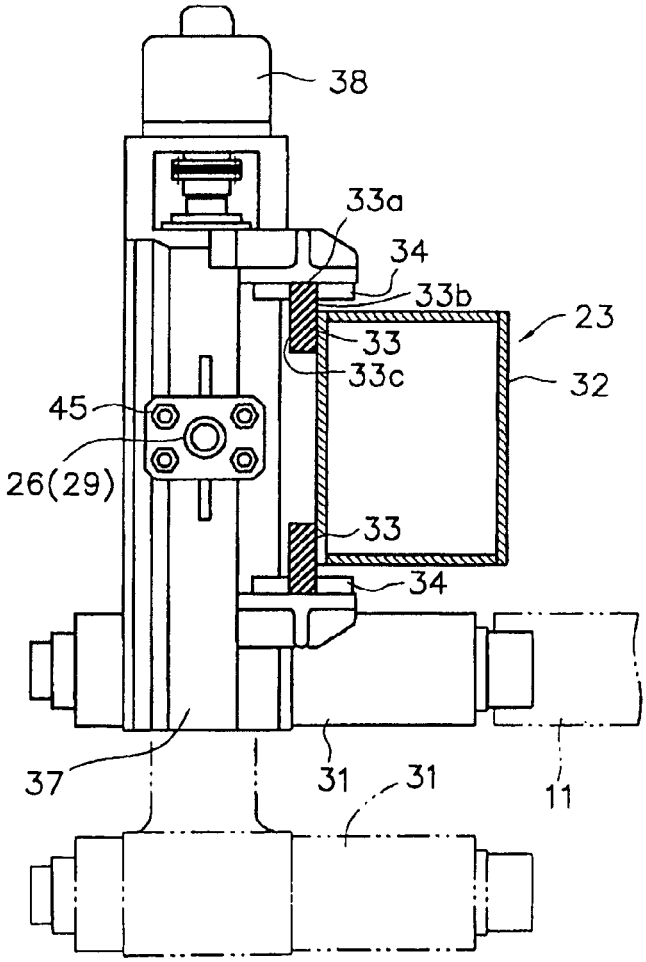
FIG. 3 is a side view on A—A in FIG. 2.
Figure 4:
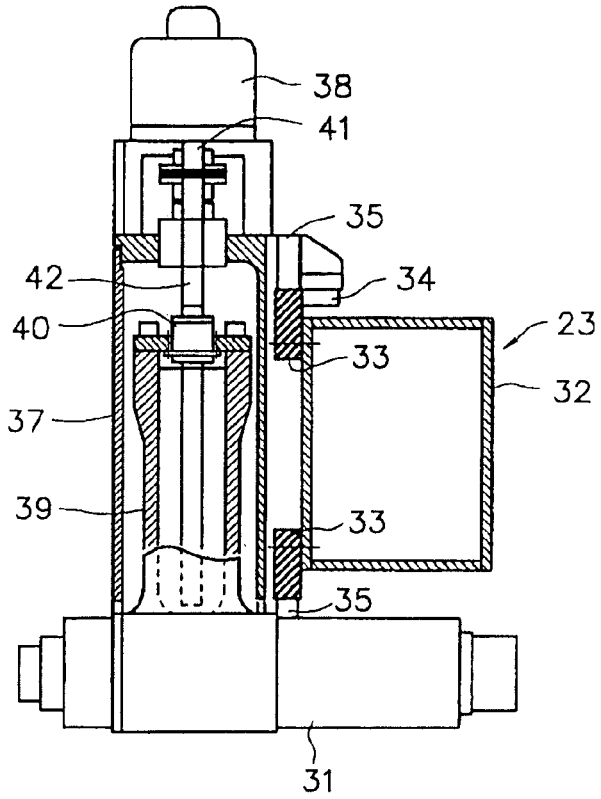
FIG. 4 is a section view on B—B in FIG. 2.

The following provides a detailed description. As shown in FIG. 3 and FIG. 4, the left and right guide beams 23 have beams 32 of rectangular hollow section, with guide rails 33 of rectangular section projecting both above and below, extending over the full length, and integrally fitted to the top and bottom edges of the outer face of the beams 32. Each guide rail 33 projecting above and below has rail faces 33*a*, 33*b*, and 33*c*. The bottom end of a rack rod 24*a* of the lifting device 24 is fitted at the required location on the top edge of the beam 32, and a pinion which is meshed with the rack of the rack rod 24*a* is connected to a servo motor 24*b* serving as a drive deice, installed at the top position. The pinion is rotated by the servo motor 24*b*, enabling raising and lowering of the rack rod 24*a* together with the guide beams 23.

Figure 2:
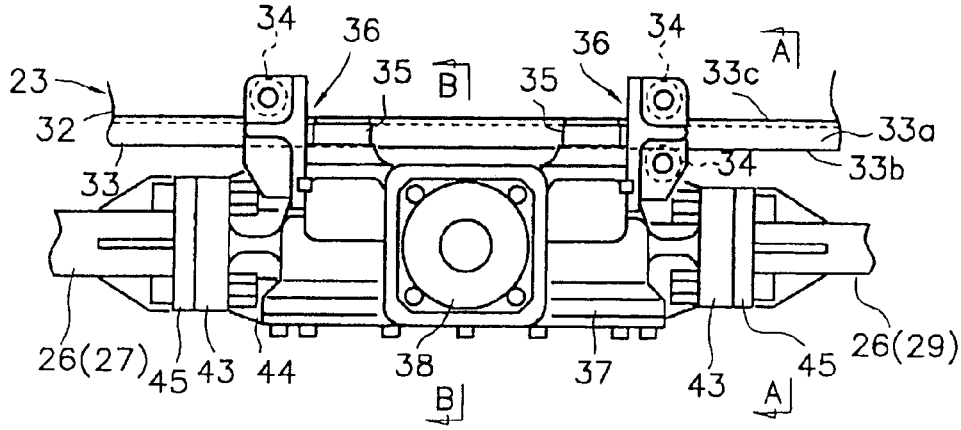
FIG. 2 is a plan view showing a carrier in FIG. 1 in detail.

As shown in FIG. 2 through FIG. 4, a guide mechanism 36 comprised of a horizontal guide roller 34 rolling on the rail faces 33*b* and 33*c*, and a vertical guide roller rolling on the rail face 33*a*, is fitted at four locations front and rear and top and bottom on the inside face of a casing 37 open at the bottom, so that the carriers 25*a*, 25*b*, 25*c*, 25*d*, 25*e*, 25*f*, and 25*g* engage with the upper and lower guide rails 33 on the guide beams 23. Furthermore, a servo motor 38 serving as a drive device, is installed on the nape of the casing 37, and a vertically moving body 39 fitted with the cross bar head 31 at the bottom end is inserted inside the casing 37 from the bottom to allow unrestrained movement only in the vertical direction (in the axial direction) along the guide members inside the casing 37. The vertically moving body 39 is fitted with a nut member 40. Moreover, a screw member 42 connected to the output shaft 41 of the servo motor 38 and which engages with the nut member 40 passing through in the vertical direction, and the vertically moving body 39 is raised and lowered via the screw member 42 driven by the servo motor 38, thus allowing the cross bar head 31 to move vertically. The carriers 25*a*, 25*b*, 25*c*, 25*d*, 25*e*, 25*f*, and 25*g* of the above configuration are assembled on the guide beams 23, such that the horizontal guide rollers 34 of each guide mechanism 36 fitted at the top and bottom engage with the rail faces 33*b* and 33*c* formed on both sides of the vertically projecting portions of the guide rail 33 so as to sandwich these from both sides of the guide rail 33, and the vertical guide rollers 35 engage such as to allow them to roll along the rail faces 33*a* formed on the top and bottom faces of the guide rail 33. This allows each of the carriers 25*a*, 25*b*, 25*c*, 25*d*, 25*e*, 25*f*, and 25*g* to move in the direction of the press line L along the guide rails 33 on the guide beams 23.

Both ends of the cross bars 11 extended horizontally at right angles to the press line L are connected and supported to allow rotation on the cross bar heads 31 supported to allow raising and lowering on the mutually opposed left and right carriers 25*a*, 25*b*, 25*c*, 25*d*, 25*e*, 25*f*, and 25*g* on either side of the press line L, and each carrier 25*a*, 25*b*, 25*c*, 25*d*, 25*e*, 25*f*, and 25*g* is driven independently by the servo motor 38 to allow the amount of raising and lowering of the cross bars 11 to be set individually.

Furthermore, a connecting rod attaching portion 44 with a flange 43 on the tip protrudes at both front and rear ends in the direction of the adjacent carriers 25*a*, 25*b*, 25*c*, 25*d*, 25*e*, 25*f*, and 25*g*, and the flange 43 of the connecting rod attaching portion 44 is abutted with the flange 45 fitted to the tips of the connecting rods 26, 27, and 29. This allows the connecting rod 27 to be connected to the most upstream side carrier 25*a*, and the connecting rods 26 and 29 to be connected to each of the other carriers 25*b*, 25*c*, 25*d*, 25*e*, 25*f*, and 25*g* respectively.

Moreover, the first carrier mechanism 28 for moving the most upstream side carrier 25*a* in the direction of the press line L has the following configuration as shown in FIG. 1. The upper and lower guide rails 33 on the guide beams 23 are assembled via rollers, and a servo motor 47 and a pinion 48 driven by the servo motor 47 are fitted to a upper moving body 46 such that it is able to move along the guide rails 33. Furthermore, racks 49 are fixed parallel to the guide beams 23, and pinions 48 are meshed with the racks 49. Moreover, the upper moving body 46 and the carrier 25*a* are connected via the connecting rod 27, and the pinion 48 is rotated by driving the servo motor 47. As a result, by rolling on the rack 49 to which the pinion 48 is fixed, the upper moving body 46 moves (under its own power) in the direction of the press line L along the guide rails 33, and the carrier 25*a* is fed between the workpiece delivery position and the first press station S1 via the connecting rod 27 to carry the workpiece.

Furthermore, as shown in FIG. 1, the configuration of the second carrier mechanism 30 for moving the carriers 25*b*, 25*c*, 25*d*, 25*e*, 25*f*, and 25*g* other than the carrier 25*a*, in the direction of the press line L is as follows. A frame 51 is installed on a base 50 at each of left and right sides of the press line L at approximately the same height as the guide beams 23, a rack 53 is supported on an upper frame 52 on the frame 51 such that it is able to move in the direction of the press line L, an end of the rack 53 on the upstream side in the press line L direction and the last carrier 25*g* at the downstream side are connected by the connecting rod 29, and the carriers 25*b*, 25*c*, 25*d*, 25*e*, 25*f*, and 25*g* are able to move together with the rack 53. Moreover, a drive device which moves the rack 53 is comprised of pinions 55 rotated by a servo motor 54, installed on an anchor block 56, the pinion 55 being meshed with the rack 53, and by rotation of the pinion 55, the rack 53 is moved along the upper frame 52 on the frame 51, thus providing feed for the carriers 25*b*, 25*c*, 25*d*, 25*e*, 25*f*, and 25*g* to carry the workpiece. The connecting portion of the connecting rod 29 connecting the rack 53 and the carrier 25*g* is able to rotate in the vertical direction, and the set position of the guide beams 23 is displaced in the vertical direction so that the feed movement accompanying movement of the rack 53 is transmitted to the carrier 25*g* smoothly, irrespective of any change in the height of the rack 53 and the carrier 25*g*.

Furthermore, the product formed at the last press station S5 at the downstream side in the press line L direction is carried from the press station S5 by the carrier motion of the cross bar 11, and a conveyor 57 to receive and transfer the product to the downstream side is installed such that its height is adjustable.

The height of the left and right guide beams 23 arranged parallel to the press line L is pre-adjusted to the height of the die for when press forming the workpiece. In this case the lifting device 24 is operated to move the guide beams 23 vertically via the rack rod 24*a*.

When the guide beams 23 are set to the predetermined height, the guide beams 23 remain fixed until the sequence of press operations is complete.

Of the carriers supported by the guide beams 23, the most upstream side carrier 25*a* in the press line L direction is connected to the upper moving body 46 of the first carrier mechanism 28 via the connecting rod 27 to provide independent feed operation by the first carrier mechanism 28. Moreover, the other carriers 25*b*, 25*c*, 25*d*, 25*e*, 25*f*, and 25*g* are interconnected by the connecting rod 26, and the most downstream side carrier 25*g* is connected to the rack 53 in the second carrier mechanism 30 via the connecting rod 29 to provide feed operation by the second carrier mechanism 30. Press operation is conducted with the mechanism described above.

Press operation involves carrying the workpiece in sequence between the first press station S1 and the fifth press station S5 while providing the predetermined press forming.

At the first press station S1 feed operation of the carrier 25*a* by driving the servo motor of the self-propelled first carrier mechanism 28, and raising and lowering of the cross bar 11 by driving the servo motor 38 fitted to the carrier 25*a*, are performed under remote control for the workpiece supplied to the upstream side of the first press station S1, for deep drawing of the material. Thus, with the cross bar 11 being operated to form a carrying motion as shown in the drawing, new workpiece is held by the workpiece holder 12 on the cross bar 11, carried above the first press station S1, and then placed on the lower die 20 of the first press station, thereby the workpiece is carried to the first press station S1.

Carriers 25*b*, 25*c*, 25*d*, 25*e*, 25*f*, and 25*g* other than the carrier 25*a*, carrying the workpiece to the first press station S1, are fed simultaneously by driving the servo motor 54 of the second carrier mechanism 30 by remote control, and driven independently by the servo motors 38 on the carriers 25*b*, 25*c*, 25*d*, 25*e*, 25*f*, and 25*g* for raising and lowering of each cross bar 11. This forms a carrying motion for each press station S1, S2, S3, S4, and S5. The predetermined press forming and processing are conducted for each press station S1, S2, S3, S4, and S5, and the workpiece is moved sequentially to the downstream side conveyor 57 from the first press station S1 via the second press station S2, third press station S3, fourth press station S4, and fifth press station S5, and discharged from the press machine by the conveyor 57.

This invention allows the most upstream side carrier 25*a* in the direction of the press line L to be disconnected from the other carriers 25*b*, 25*c*, 25*d*, 25*e*, 25*f*, and 25*g* for separate feed, and each carrier 25*a*, 25*b*, 25*c*, 25*d*, 25*e*, 25*f*, and 25*g* to be raised and lowered independently. Therefore optimum carrying motion can be set without restriction by the dies at each press station S1, S2, S3, S4, and S5, thus allowing a variety of shapes of sheet, and a reduction in carrying time, and increasing the number of press cycles per unit time, thus enabling productivity to be raised.

Figure 5:
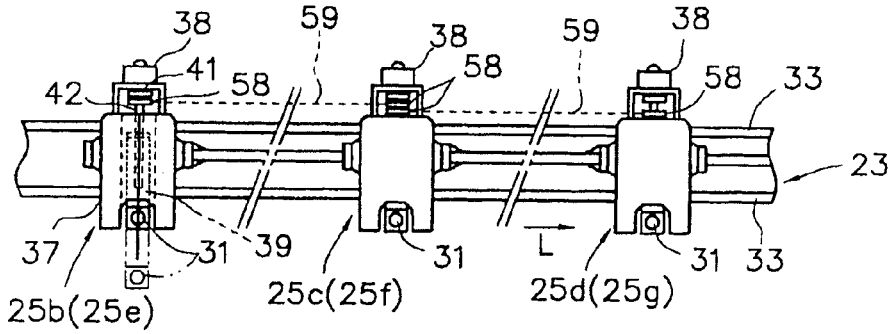
FIG. 5 is a schematic diagram showing another aspect of the embodiment according to the present invention.

FIG. 5 shows another aspect of the embodiment according to the present invention. In FIG. 1 the servo motors 38 for each carrier 25*a*, 25*b*, 25*c*, 25*d*, 25*e*, 25*f*, and 25*g* performs lift operation independently by remote operation. Instead of this configuration, in this other aspect of the embodiment of the invention, of the carriers 25*b*, 25*c*, 25*d*, 25*e*, 25*f*, and 25*g* other than the most upstream side carrier 25*a*, two or three adjacent carriers, for example 25*b*, 25*c*, and 25*d*, or 25*e*, 25*f*, and 25*g*, work together to perform lift operation so that the cross bars 11 are raised and lowered in synchronization with each other.

In other words, a single stage or two stage (two stage provided for intermediate position) pulley or chain wheel (chain wheel shown in drawing) 58 is fitted to the screw member 42 connected to the output shaft 41 of the servo motor 38 installed on each carrier 25*b*, 25*c*, 25*d*, 25*e*, 25*f*, and 25*g*, with an endless belt or chain 59 spanning the screw members 42 of the carriers 25*b* and 25*c*, and 25*c* and 25*d*, or between the screw members 42 of the carriers 25*e* and 25*f*, and 25*f* and 25*g*. This arrangement ensures simultaneous transmission of power by the belt or chain 59 without needing drive from one of the servo motors 38, for either of the two groups of three carriers 25*b*, 25*c*, and 25*d* or 25*e*, 25*f*, and 25*g*, so that the multiple carriers 25*b*, 25*c*, and 25*d*, or 25*e*, 25*f*, and 25*g* are lifted simultaneously and in synchronization, and each cross bar 11 is raised and lowered simultaneously by the same amount, thus lifting the workpiece.

According to this embodiment, when carrier motion between adjacent press stations is the same, operation with a single group of servo motors 38 as the drive device is possible, allowing a reduction in the number of actuators requiring control, and allowing lift action with a single group of servo motors 38 irrespective of a fault in a servo motor 38.

Figure 6:
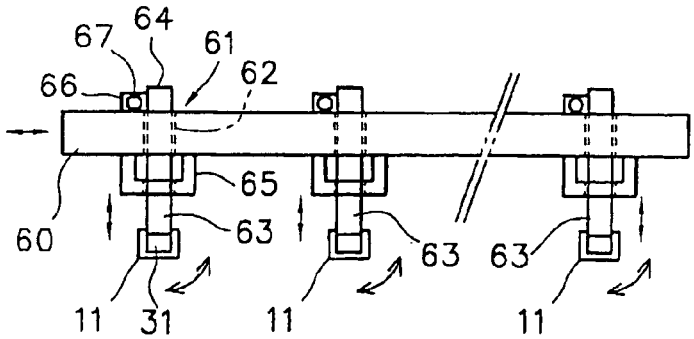
FIG. 6 is a schematic diagram showing yet another aspect of the embodiment according to the present invention.

Furthermore, FIG. 6 shows yet another aspect of the embodiment according to the present invention. In the embodiment shown in FIG. 1, the carriers 25*a*, 25*b*, 25*c*. 25*d*, 25*e*, 25*f*, and 25*g* move in the press line L direction along the guide rails 33 on the guide beams 23, and the servo motors 38 serving as lifting devices are mounted on each carrier, and the servo motors 38 raises and lowers the cross bars 11. Instead of this configuration, in this other aspect of the embodiment of the invention, independently acting lifting devices 61 are fitted to a feed beam 60 which allows the beam to move in the press line L direction, and the cross bars 11 are raised and lowered by the lifting devices 61.

In other words, through holes 62 in the vertical direction are provided at required spacing in the feed beams 60 arranged at left and right of the press line L and capable of movement in the feed direction via a drive mechanism not shown in the drawing, a vertically moving body 63 passes through the through holes 62 such that it is capable of movement in the vertical direction, and the vertically moving body 63 is supported passing through a slide frame 65 fitted to the bottom face of the feed beam 60, such that it is capable of sliding in the vertical direction. Moreover, a rack 64 is provided on the upper end of the vertically moving body 63, and a pinion 67 rotated by a drive device 66 mounted on the feed beams 60 is meshed with the rack 64. Furthermore, both ends of the cross bar 11 extending in a direction at right angles to the press line L are rotatably fitted to the cross bar head 31 on the bottom end of the vertically moving body 63, and raising and lowering of the vertically moving body 63 by means of the pinion 67 and the rack 64 enables raising and lowering of the cross bar 11.

Figure 7:
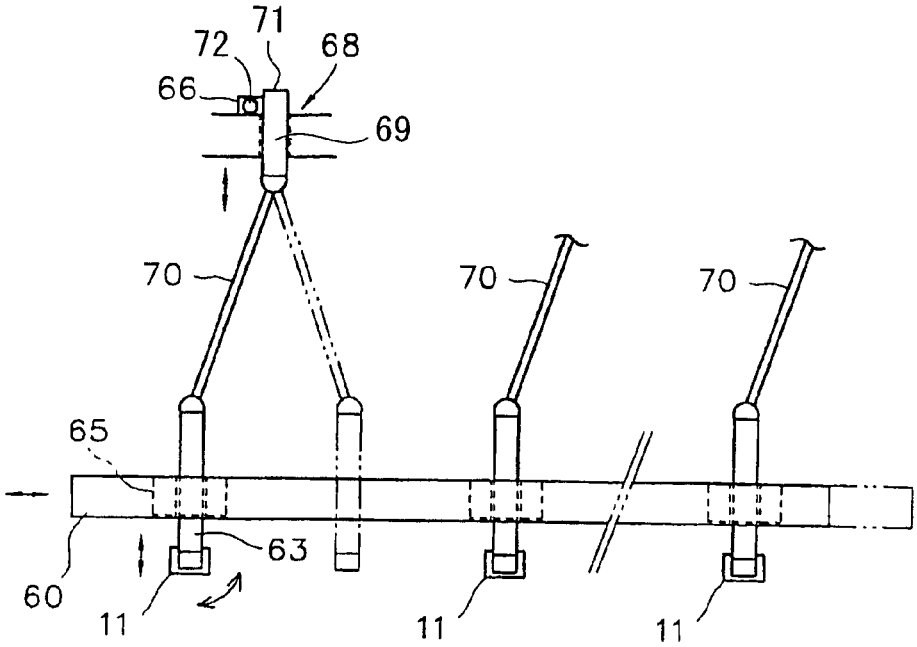
FIG. 7 is a schematic diagram showing yet a different aspect of the embodiment according to the present invention.

FIG. 7 shows yet a different aspect of the embodiment according to the present invention. Slide frame 65 are fitted into the left and right feed beams 60 at required spacing, and the vertically moving body 63 fitted such as to allow the cross bar 11 to rotate on the cross bar head 31 at the bottom end, is supported passing through the slide frame 65 to allow it to slide in the vertical direction. Moreover, the bottom end of a vertically moving body 69 on a lifting device 68 installed above the feed beam 60, is connected to the top end of the vertically moving body 63 via a connecting rod 70 in a freely swinging manner, and the vertically moving body 69 on the lifting device 68 is raised and lowered by a pinion 72 and a rack 71 in the same manner as shown in FIG. 6. This configuration allows the vertically moving body 63 to be raised and lowered via the connecting rod 70, thus raising and lowering the cross bar 11, and provides feed to the feed beam 60. As shown by the solid and dotted lines, this allows the cross bar 11 to be displaced in the direction of the press line L, thus allowing the cross bar 11 to perform feed operation and lifting operation.

Figure 8:
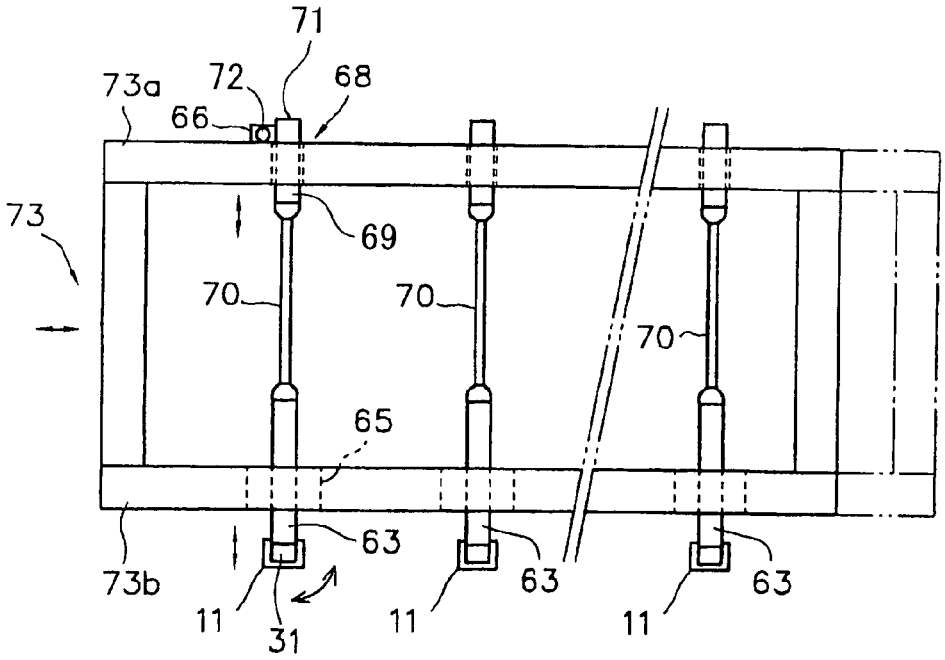
FIG. 8 is a schematic diagram showing a variation of FIG. 7.
Figure 9:
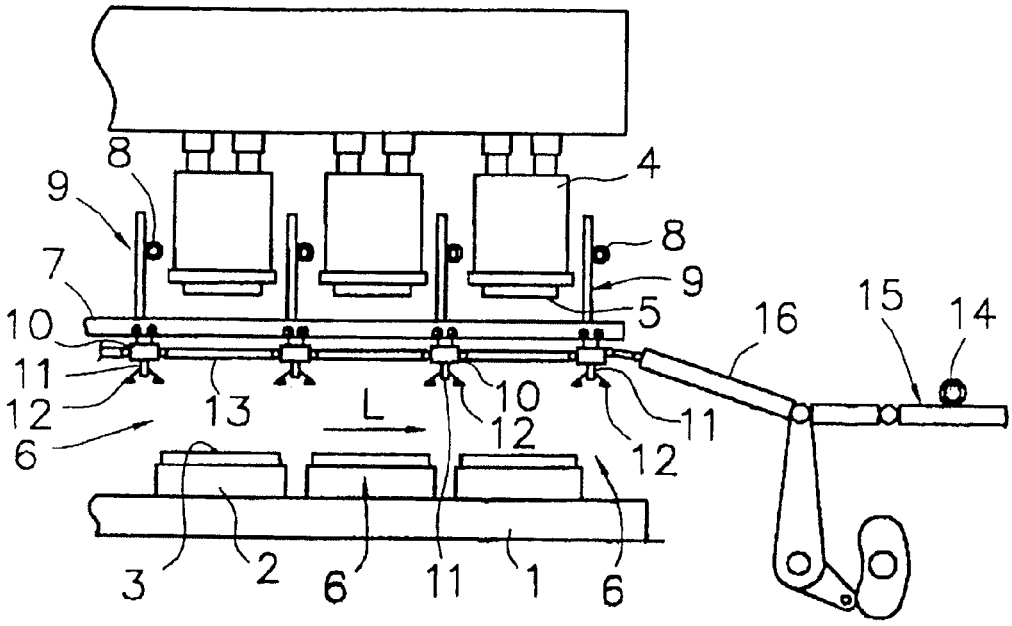
FIG. 9 shows an example of a conventional workpiece carrier apparatus for transfer press machine.

Furthermore, FIG. 8 shows a variation of FIG. 7, in which the feed beams arranged symmetrically on the left and right along the press line L as shown in FIG. 7, form an integrated feed beam 73 comprising an upper feed beam 73*a* and a lower feed beam 73*b*, and are able to move in the direction of the press line L. Moreover, the vertically moving body 63 is fitted to the lower feed beam 73*b* such as to allow unrestrained raising and lowering in the same manner as for the embodiment in FIG. 7, the lifting device 68 installed above in the embodiment in FIG. 7, is installed on the upper feed beam 73*a*, the top end of the vertically moving body 63 is connected to the vertically moving body 69 of the lifting device 68 via a connecting rod 70, and the cross bar 11 is able to be raised and lowered via the connecting rod 70 and the vertically moving body 63, by means of operation of the lifting device 68 on the upper feed beam 73*a*. Other configurations are the same as those shown in FIG. 7, and the same components are denoted by the same reference symbols.

According to the embodiments shown in FIG. 6 through FIG. 8, in the structures where the feed beam are adopted, each lifting device can be operated independently, and independent and unrestrained carrying motion can be formed for each press station.

The present invention is not limited to the various embodiments described above in which carrying and lifting operation of each carrier 25*a*, 25*b*, 25*c*, 25*d*, 25*e*, 25*f*, and 25*g* is performed by servo control mechanisms employing servo motors 47, 54, and 38 as actuators. Therefore, the servo control may optionally include variable speed control, and it will be understood that other various modifications within a scope which does not depart from the gist of the present invention are also possible.

What is claimed is:

1. A workpiece carrier apparatus for transfer press machine comprising:

guide beams which are arranged on a left and right side of a press line;

a plurality of carriers which are supported by the guide beams such as to allow movement in a direction of the press line;

cross bars which are provided with workpiece holders and are attached to the carriers such as to be capable of being raised and lowered;

a first carrier mechanism which feeds a carrier located on a most upstream side in the direction of the press line, in the press line direction; and a second carrier mechanism which feeds a plurality of carriers located downstream, in the press line direction, wherein the second carrier mechanism performs a feed operation for the plurality of the carriers located downstream which is different from a feed operation for the carrier located on the most upstream side performed by the first carrier mechanism, the plurality of the carriers located downstream are connected together and are moved together in the direction of the press line by the second carrier mechanism, each of the carriers comprises a vertically moving body capable of being raised and lowered, and the workpiece carrier apparatus further comprises: drive devices to raise and lower vertically moving bodies of a plurality of groups of adjacent carriers; and a power transmission mechanism connecting the drive devices, and the vertically moving bodies are raised or lowered simultaneously by any of the drive devices corresponding to the respective groups, and the cross bars are fitted between vertically moving bodies of mutually opposed carriers on the left and right guide beams.

2. A workpiece carrier apparatus for transfer press machine according to claim 1, wherein the vertically moving bodies are capable of being raised and lowered independently.

3. A workpiece carrier apparatus for transfer press machine according to claim 1 or claim 2, wherein there is further provided a lifting device which raises and lowers the guide beams.

4. A workpiece carrier apparatus for transfer press machine comprising:

feed beams which are arranged on a left and right side of a press line and which are movable in a direction of the press line;

vertically moving bodies which are fitted at required locations for the feed beams so as to be capable of being raised and lowered;

lifting devices which are installed corresponding to each vertically moving body for raising and lowering the vertically moving bodies; and cross bars which are provided with workpiece holders, and are fitted between mutually opposed vertically moving bodies provided on the feed beams, wherein the lifting devices are installed at positions above the feed beams, and the workpiece carrier apparatus is further provided with a connecting rod which connects the lifting devices and the vertically moving bodies in a freely swinging manner.

5. A workpiece carrier apparatus for transfer press machine according to claim 4, wherein each of the lifting devices is installed above each of the feed beams and corresponding to the vertically moving body.

6. A workpiece apparatus for transfer press machine according to claim 4, wherein the respective lifting devices are driven independently.

7. A workpiece carrier apparatus for transfer press machine according to claim 6, wherein each of the lifting devices is installed above each of the feed beams and corresponding to the vertically moving body.

* * * * *

UNITED STATES PATENT AND TRADEMARK OFFICE

CERTIFICATE OF CORRECTION

PATENT NO. : 7,047,790 B2
APPLICATION NO. : 10/663224
DATED : May 23, 2006
INVENTOR(S) : Suzuki et al.

It is certified that error appears in the above-identified patent and that said Letters Patent is hereby corrected as shown below:

On Title Page, Item (30) col. 1 should read,

Foreign Application Priority Data
Sep. 18, 2002 [JP] Japan 2002-271494

Signed and Sealed this

Fifth Day of September, 2006

JON W. DUDAS
*Director of the United States Patent and Trademark Office*